US007971277B2

(12) United States Patent
Romiti

(10) Patent No.: US 7,971,277 B2
(45) Date of Patent: Jul. 5, 2011

(54) DETACHABLE MAGNETIC HOLDER

(76) Inventor: Gail Marie Romiti, Sterling, VA (US)

( * ) Notice: Subject to any disclaimer, the term of this patent is extended or adjusted under 35 U.S.C. 154(b) by 143 days.

(21) Appl. No.: 12/385,592

(22) Filed: Apr. 13, 2009

(65) Prior Publication Data

US 2010/0095427 A1 Apr. 22, 2010

(51) Int. Cl.
*A41D 27/02* (2006.01)
*A41D 19/00* (2006.01)
*A41D 20/00* (2006.01)

(52) U.S. Cl. ..... 2/162; 2/167; 2/170; 2/249; 2/251

(58) Field of Classification Search ..... None
See application file for complete search history.

(56) References Cited

U.S. PATENT DOCUMENTS 2,152,897 A * 4/1939 Madore ..... 24/303
2,176,052 A * 10/1939 Beyer ..... 132/331
3,629,867 A * 12/1971 Taylor ..... 2/160
3,755,857 A * 9/1973 Simoneaux ..... 24/3.2
3,868,016 A * 2/1975 Szpur et al. ..... 206/350
3,869,762 A * 3/1975 Barrett et al. ..... 24/302
4,325,504 A * 4/1982 Amani ..... 224/183
4,779,312 A * 10/1988 Carlson ..... 24/3.2
4,826,059 A * 5/1989 Bosch et al. ..... 224/183
4,905,335 A * 3/1990 Tervola ..... 7/169
5,003,637 A * 4/1991 Lonon ..... 2/160
5,056,661 A * 10/1991 Balzano ..... 206/372
5,070,563 A * 12/1991 Tervola ..... 7/169
5,196,818 A * 3/1993 Anderson ..... 335/285
5,201,444 A * 4/1993 Simonet ..... 224/183
5,213,240 A * 5/1993 Dietz et al. ..... 224/183
5,333,767 A * 8/1994 Anderson ..... 224/183
5,345,368 A * 9/1994 Huff ..... 362/103
5,432,986 A * 7/1995 Sexton ..... 24/303
5,456,037 A * 10/1995 Dorval ..... 43/11
D364,955 S * 12/1995 Gringer et al. ..... D3/228
5,507,041 A * 4/1996 Wright ..... 2/21
D374,767 S * 10/1996 Leach ..... D3/218
D374,984 S * 10/1996 Scott ..... D3/228
5,593,073 A * 1/1997 Finnegan ..... 224/183
5,758,807 A * 6/1998 Wright ..... 224/183
6,401,253 B2 * 6/2002 Brunson ..... 2/160
7,146,651 B1 * 12/2006 Lapin ..... 2/338
7,310,035 B2 * 12/2007 Wooten ..... 335/306
D564,981 S * 3/2008 Johnson ..... D13/183
D564,982 S * 3/2008 Johnson ..... D13/183
2005/0178155 A1 * 8/2005 Poli ..... 63/29.2

* cited by examiner

*Primary Examiner* — Bobby H Muromoto, Jr.

(57) ABSTRACT

A detachable magnetic holder having a top side to gather implements and a bottom side that is interchangeable therewith top side for removable attachment from a base by a handle incorporated into a utility shape to gather, find, and hold ferromagnetic implements used by hobbyists and professional craftsmen engaged in fabrication of finished goods.

10 Claims, 2 Drawing Sheets

DETACHABLE MAGNETIC HOLDER

BACKGROUND OF INVENTION TECHNICAL FIELD

This invention relates to improvements made to detachable magnetic holder and, more particularly, enhancements for detachable magnetic holder that is useful on behalf of hobbyists and tradesmen who are engaged in assembly and fabrication of consumer goods. Fabrication of goods often requires repetitive motion using implements with magnetic response. Detachable magnetic holder saves time and increases productivity to quickly gather, find, and hold implements, and limits the need for a greater range of motion by keeping implements within arm's reach. Detachable magnetic holder is useful with, but not limited to, pins, needles, bobby pins, hair clips, screws, anchors, tacks, pegs, spikes, paper clips, miniature tools like scissors, and screw drivers, and may include any common ferromagnetic devices or small tools that have a magnetic response and have a proportionate size so that one or more such implements will fit thereonto the detachable magnetic holder which attaches to a base which is located thereonto a glove apparatus or a wristband apparatus. The detachable magnetic holder is useful in any vocation or hobby where fabrication methods utilize small ferromagnetic implements for production of, for example, textiles, clothing, home apparel, jewelry, cabinetry, radios, computers, scrapbooks, hairdos, and may be used by tailors, carpenters, jewelry makers, office workers, mechanics, and hairdressers. This description means to include all workers who regularly utilize ferromagnetic implements and devices for production of finished goods.

BACKGROUND ART

The "Wrist-Carried" implement holders (U.S. Pat. No. 2,176,052) by F. H. BEYER is not instantly removable from the wristband but is held in place by a screw therefore general description of wrist-carried implement holder has no handle and is semi-permanently attached as screw would need to be loosened before removal could take place, in comparison to inventive detachable magnetic holder described herewith which instantly lifts off a base by its handle.

The "Magnet Clip" (U.S. Pat. No. 2,152,897) by A. H. MADORE has removable attachment from wristband by spring-loaded jaw mechanism extending therefrom U-shaped magnetic body, whereas detachable magnetic holder is attached to a ferromagnetic base by simple laws of attraction between composition of said detachable magnetic holder and composition of a base for detachable magnetic holder. The finger described therewith "Magnetic Clip" is perceived as an add-on extension for gathering implements but not the intension of said finger to act as a lever for removable attachment therefrom base located thereon a wristband apparatus or a glove apparatus; furthermore, when spring-loaded mechanism engages finger said device has no means to attach to wristband apparatus.

The last relevant prior art reference found relates to the "Workers Aid System and Modified Glove" (U.S. Pat. No. 6,401,253 B2) invented by Mark E BRUNSON. It teaches a workers glove utilizing a hook and loop system for interchangeable attachment of empty container, a flashlight, a tape measure, a plumb bob, and a notepad, said interchangeable system keeps at least one apparatus attached thereonto glove at all times. The most defining difference is that BRUNSEN does not have a handle incorporated therewith container and container has sidewalls to contain implements, therefore user must manually pick up and place ferromagnetic devices thereinto said container, whereas said detachable magnetic holder utilizes utility shape and magnetic attractive force to gather said devices.

SUMMARY OF INVENTION

The present invention is a detachable magnetic holder with utility shape that could be described as paddle or three-dimensional object with enough depth to embed a magnet into surface area having a top side to gather and hold ferromagnetic implements, a bottom side for instant connection to a base, and which incorporates a handle to operate device. Said shape has utility purpose of control by handle for instantaneous removable attachment therefrom base, and to pick-up, locate, and gather said implements. Said handle acts like a lever for control to manipulate and to manage implements. Said shape includes a surface area with magnet positioned in the center thereof as to attract implements toward center of surface area keeping handle free and clear from debris of ferromagnetic devices and implements. Preferred shape of surface area is rounded like a disk or squared, both shapes incorporate a handle for lifting detachable magnetic holder from base.

Base refers to pedestal permanently affixed to a glove, a wristband, a pair of wristbands, or a pair of gloves. The portion of base made from ferromagnetic properties may be stamped out of sheet metal or cast from a mold then incorporated into a wristband apparatus or a glove apparatus. When working with your hands many operations requires ambidextrous skill, therefore it is the purpose of detachable magnetic holder to devise a system for instant removable attachment of detachable magnetic holder from a base by a lever incorporated thereinto a utility shape. For instance, when pinning, a right-handed person may place detachable magnetic holder thereonto a base positioned on left-handed wristband apparatus or glove apparatus, then when sitting at the sewing machine to remove pins with the left hand the user would position the detachable magnetic holder thereonto a ferromagnetic base located thereon right-handed wristband apparatus or glove apparatus. As part of a system devised for craftsmen and tradesmen to use efficient hand operations this description details the composition of the base and locations of the base thereon a wristband apparatus and a glove apparatus. A benefit of detachable magnetic holder is that detachable magnetic holder can be removed therefrom a wristband apparatus or glove apparatus therewith implements thereon to be stored out of the way when necessary. Any flat surface area for storage is obvious, yet there are infinite ferromagnetic surfaces that can be found in most environments such as, metal filing cabinet for the office worker, industrial sewing machine for the tailor, and automobile for the mechanic. Workshops are filled with ferromagnetic metal machinery utilized by craftsmen and tradesmen with many nooks to place detachable magnetic holder. Most rooms have wall corners that are reinforced by metal sheathing; even a refrigerator is possible location to store detachable magnetic holder. An example of finding ferromagnetic objects using detachable magnetic holder is for the carpenter to locate a wooden stud by nail head found in drywall indicates a support beam. Herewith said wristband apparatus the position of ferromagnetic base would be positioned by the wearer of the wristband apparatus thereonto arm. The location of said base on glove could be on dorsal backside of gloved hand or backside, inner side or underside of glove's cuff depending on best functionality for worker's hand operations. The ferromagnetic base is positioned thereonto glove and permanently incorporated thereinto a glove and may be sewn into a pocket, or base may utilize magnetically attractive metal plug with teeth held on by plugs with teeth clamping thereinto place. Said base is not limited to described base inasmuch as snaps, hook and loop or any other system known or unknown could be used to incorporate a base to receive detachable magnet holder thereonto a wristband apparatus or on a glove apparatus.

Said detachable magnetic holder is fashioned with handle to act as a lever for attachment and release to maximize ergonomic productivity by simply lifting detachable magnetic holder off a glove apparatus or a wristband apparatus and waving detachable magnetic holder over loose ferromagnetic metal objects, then returning to a base located thereon a wristband apparatus or a glove apparatus all of which limits the need for a greater range of motion and repetitive motions to save time and work more efficiently by gathering, locating, and holding small tools and devices with a magnetic response.

BRIEF DESCRIPTION. OF DRAWINGS

DESCRIPTION OF PREFERRED EMBODIMENTS

Figure 1:
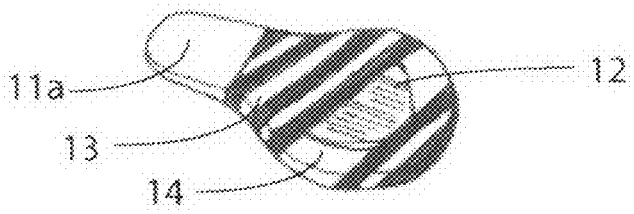
FIG. 1 illustrates features of detachable magnetic holder.
Figure 6:
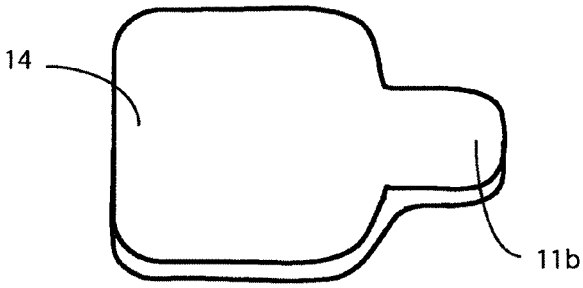
FIG. 6 is side-angled view of cast detachable magnetic holder from two-part mold.
Figure 8:
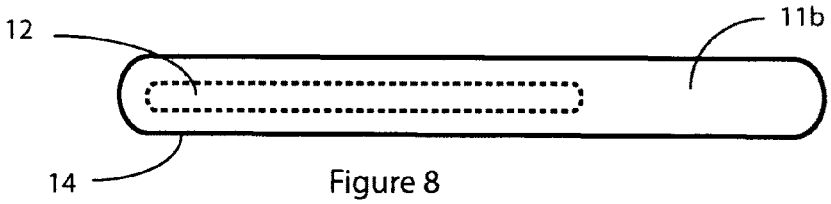
FIG. 8 is cross section of figure five.
Figure 9:
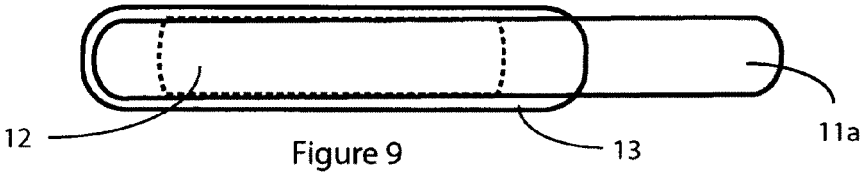
FIG. 9 is cross section of figure one.

FIG. 1 is detachable magnetic holder shaped by laser cutting, also shown by side view FIG. 9, or formed by two-part mold FIG. 6 or injection mold, FIG. 8, process to cast desired shape and size. Detachable Magnetic Holder 1*b* refers to all species of detachable magnetic holder 1*b*. Suitable materials for manufacturing process are any polymer, acrylic, PVC and soft polyvinyl rubber like material combination or any suitable compounds that will form a structure rigid enough to gather and support implements while encasing magnet.

Figure 7:
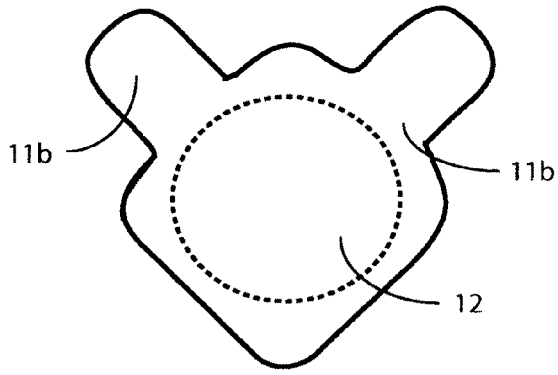
FIG. 7 is alternative embodiment for detachable magnetic holder having more than one handle.

The handle 11*a*-11*b* also considered to be a lever 11*a*-11*b* is incorporated into surface area 14; surface area 14 has a top side for collecting implements and a bottom side for instant connection to a base 22*a*-22*c* affixed thereonto a glove apparatus 3 or a wristband apparatus 2. Detachable magnetic holder 1*b* may incorporate additional handles 11*a*-11*b*, illustrated by FIG. 7 revealing a round magnet 12; any shaped magnet 12 may be used in any configured shape of surface area 14 of detachable magnetic holder 1*b* as long as one or more handles 11*a*-11*b* are incorporated thereinto shape for control of said devices.

Figure 5:
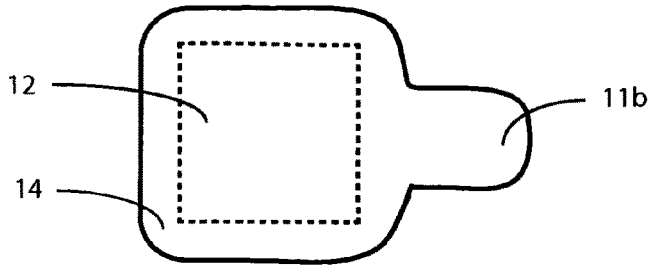
FIG. 5 is plane view of detachable magnetic holder with squared shape and square magnet.

Surface area 14 may be rounded, illustrated in FIG. 1, or have squared surface area 14 with handle 11*a*-11*b* incorporated thereinto FIG. 5. FIG. 6 illustrates angled side view of detachable magnetic holder made from a two-part mold. Said detachable magnetic holder 1*b* is devised for removable attachment by handle 11*a*-11*b* thereonto at least one glove apparatus FIG. 3; alternatively, detachable magnetic holder 1*b* can be placed thereon at least one wristband apparatus FIG. 2 to be worn by a hobbyist or professional tradesmen.

The magnet 12 is preferably a neodymium magnet 12 known as a rare earth magnet 12 although any magnet 12 can be substituted. Said magnet 12 may be a round FIG. 6 magnet 12, or a square FIG. 5 magnet 12 embedded into surface area 14. It is preferable that magnet 12 is positioned into the center of surface area 14, to guide implements away from handle 11*a*-11*b* so that lever 11*a*-11*b* will be free and clear of implements for improved control of detachable magnetic holder 1*b*.

Placement of magnet 12 may be glued thereon top of laser cut shape FIG. 1, or held in place by relief formed to contain magnet 12 thereinto surface area 14, and may offset embedded magnet 12 within surface area 14 therefore one side possessing a stronger magnetic attraction to ferromagnetic base 22*a*-22*c* defining top side and bottom side; alternatively, a uniform relief centering magnet within surface area of detachable magnetic holder 1*b* would have equal strength thereon both the top side and bottom side of detachable magnetic holder 1*b*. If magnet 12 is not concealed by casts from one part mold or two-part mold, additional step to sheath 13 magnet 12 as to encase magnet 12 to guard from dangerous shrapnel that may happen from impact therewith a neodymium magnet 12. Ideally, detachable magnetic holder 1*b* is formed in one-step process as to encase the magnet 12 into shape by injection mold process FIG. 8. An alternative method conceived to embed magnet 12 into surface area is by cutting out shape of detachable magnetic holder FIG. 1 then incorporate magnet 12 thereinto shape and dip into liquid polyurethane material, or by placing plastic or rubberized sleeve over surface area 14 to hold and conceal magnet 12 thereinto surface area 14; this description means to include any method known or unknown to embed a magnet into a surface area to create the same.

Said detachable magnetic holder 1*b* shall be at least 2" in length to include handle 11*a*-11*b*, at least 1" wide and at least 2 mm thick. The size of detachable magnetic holder 1*b* may be longer, surface area 14 for collecting implements maybe wider and depth of detachable magnetic holder 1*b* may be thicker as long as dimensions are intended for placement thereonto a wristband apparatus FIG. 2 or a glove apparatus FIG. 3 for controlling implements thereby lever 11*a*-11*b* during fabrication of finished goods by a professional worker or a hobbyist.

Figure 2:
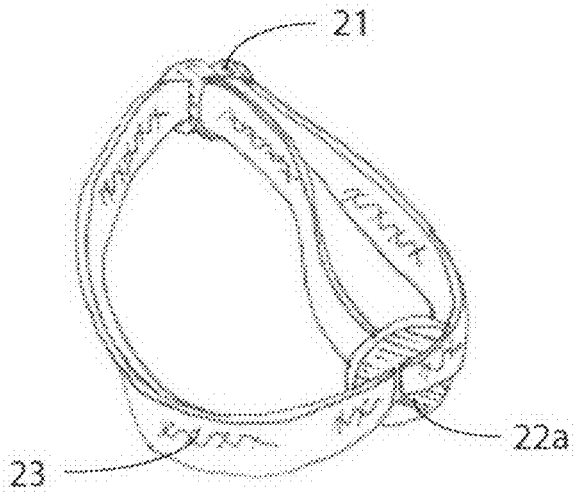
FIG. 2 is adjustable wristband apparatus for detachable magnetic holder.
Figure 4:
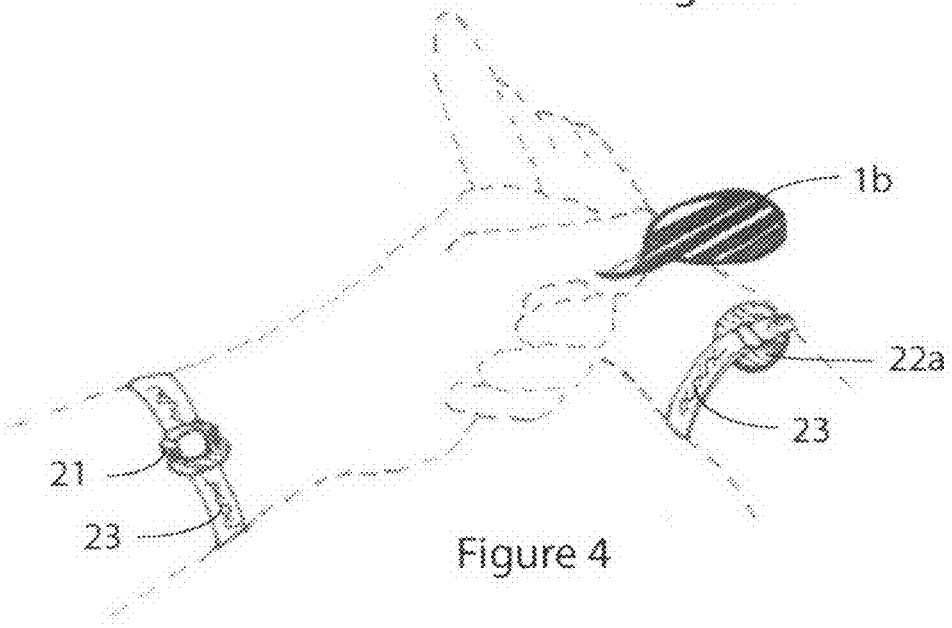
FIG. 4 illustrates pair of wristband apparatus with detachable magnetic holder.

FIG. 4 is a pair of wristband apparatus FIG. 2 with detachable magnetic holder 1*b* ready for placement thereonto a base 22*a*-22*c*. An adjustable wristband, FIG. 2, uses a strap 23 made of elastic, synthetic, non-synthetic, woven, or non-woven material. A slider that is made of plastic is commonly called a tri-glide 21, and when made of metal called a slider 21; said slider 21 or tri-glide 21 adjusts size of wristband apparatus FIG. 2. Said slider 21 is fashioned to look like the number eight and resembles a belt buckle having two outer sides and one inside member used to adjust size of wristband apparatus FIG. 2. One end of strap 23 is threaded through a base 22*a*-22*c* then anchored by stitches or other means to secure in place; a tri-glide 21 or slider 21 is positioned thereon strap; other end of strap is threaded from outside in through opposing side of base 22*ba*-22*c* then threaded through inner side of slider 21 where strap is anchored to secure thereonto slider 21. The described composition of wristband apparatus FIG. 2 having a base 22*a*-22*c* therewith strap adjusted by slider 21 or tri-glide 21 is preferred embodiment; detachable magnetic holder 1*b* is not limited to said method of making adjustable wristband apparatus FIG. 2 for detachable magnetic holder 1*b* may include a snap or a hook and loop system as part of wristband apparatus FIG. 2 for adjusting the size thereof. Wristband apparatus FIG. 2 is not limited to said description and includes any process known or unknown to create the same.

Figure 3:
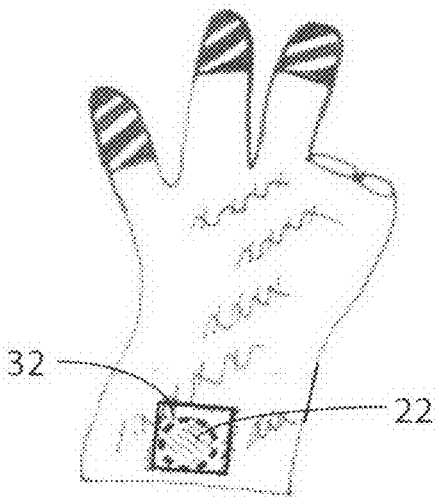
FIG. 3 is glove apparatus for detachable magnetic holder.

The glove apparatus FIG. 3 has three fingers sheaths, however said glove 3 is not limited to three fingers sheaths inasmuch as said glove FIG. 3 could have five finger sheaths or fewer finger sheaths with or without grip devices as part of glove apparatus FIG. 3 as long as a base is incorporated thereinto. Said base consists of piece of non-corrosive magnetically attractive piece of metal or a magnet sewn thereinto a pocket 32 attached thereonto dorsal backside of gloved hand, or backside, inner side and underside within cuff area; location of said base 22*a*-22*b* is positioned to suit user's application. Said glove apparatus FIG. 3 may be worn as one glove apparatus FIG. 3 or worn as a pair of glove apparatus FIG. 3 for system of ambidextrous instant removable attachment of detachable magnetic holder 1*b* thereon a base.

Figure 10:
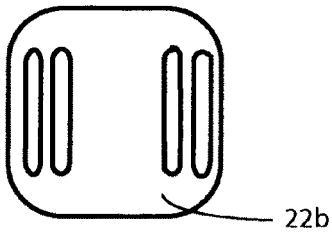
FIG. 10 is alternative base species for wristband apparatus.
Figure 11:
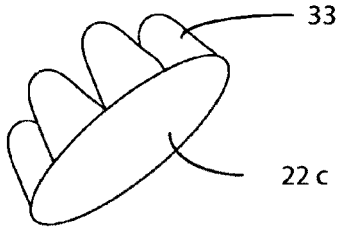
FIG. 11 is ferromagnetic metal plug used as alternative base species for glove apparatus.

Base 22*a*-11*b* is best described as a piece of ferromagnetic metal with ability to attract detachable magnetic holder 1*b*. A magnet 12 can be incorporated into base 22*a*-22*c* directing a top side and bottom side by polar attraction to naturally select a bottom side and top side thereof detachable magnetic holder 1*b* for placement thereonto said magnetic base 22*a*-22*c*. The portion of base 22*a*-22*c* made from ferromagnetic properties may be stamped out of sheet metal or cast from a mold then incorporated into wristband apparatus FIG. 2 or glove apparatus FIG. 3 but is not limited to said method of production and may utilize any method known or unknown to create the same. It is common knowledge that iron and other magnetically attractive metals and magnets may corrode, rust or tarnish by nature and, if they came in direct contact with the skin, could cause the skin to discolor or could cause an allergic reaction. Therefore a coating will need to be applied to attractive metal base 22*a*-22*c* or magnet base 22*a*-22*c* to prevent direct contact of said base 22*a*-22*c* with the skin. Some known solutions contemplated by this description include a nickel or other corrosion resistant metal plating or coating for base 22*a*-22*c*, or a polymer coating and any corrosion resistant magnetically attractive metal placed within pocket 32 sewn into a glove apparatus FIG. 3 and a pocket 32 containing a base 22*a*-22*c* may be incorporated into a wristband apparatus FIG. 2. FIG. 10 is base 22*b* species for wristband apparatus FIG. 2 having four openings to thread wristband strap 23 there through base 22*b* as described. FIG. 11 is alternative base 22*c* that is a common plug that utilizes its teeth 33 to pierce through material securing base thereonto glove apparatus FIG. 3.

Detachable magnetic holder 1*b* is not limited to described construction inasmuch as any base 22*a*-22*c* thereonto a wristband apparatus FIG. 2 or glove apparatus FIG. 3 of any configuration for efficient placement and release of detachable magnetic holder 1*b* is embodied by this description.

I claim:

1. A craftsmen's device comprising: a detachable magnetic holder to collect and hold ferromagnetic implements in a single hand operation of limited range of motion:

at least one magnet embedded into a molded surface area to prevent shrapnel danger from debris of shattering magnet;

said surface area having a top side to hold said implements, and a thickened edge uninhibited by elevated sidewalls to collect said implements;

a bottom side for placement thereonto a base, said surface area comprising a handle;

said handle comprising a lever to control said implements;

said magnet is located at the center of molded thickened surface area and draws said implements away from molded handle to prevent injury to fingers from sharp implements.

2. The device of claim 1 as part of a system for removable attachment of said detachable magnetic holder from a base located thereon wristband apparatus to be interchangeable in location therefrom right-handed wristband apparatus thereonto left-handed wristband apparatus.

3. A device of claim 1 wherein said detachable magnetic holder has more than one handle to function as a lever for control of said ferromagnetic implements.

4. A device of claim 1 wherein said surface area shape is substantially squared.

5. A device of claim 1, wherein said surface area shape is substantially rounded.

6. A device of claim 1 wherein base for said detachable magnetic holder comprises magnetic material.

7. A device of claim 1 whereas base for said detachable magnetic holder incorporates ferromagnetic metal.

8. A device of claim 1 as part of a system for removable attachment of said detachable magnetic holder from said base located thereon a glove apparatus to be interchangeable in location therefrom right-handed glove apparatus thereonto left-handed glove apparatus.

9. The device of claim 1 for removable attachment of said detachable magnetic holder from said base located thereon a wristband apparatus.

10. The device of claim 1 for removable attachment of said detachable magnetic holder from said base located thereon a glove apparatus; said base comprising a common plug having elevated teeth to pierce material to secure said base thereonto said glove.

* * * * *